US009908152B2

(12) United States Patent
Sielermann et al.

(10) Patent No.: US 9,908,152 B2
(45) Date of Patent: Mar. 6, 2018

(54) METHOD FOR SORTING LAUNDRY ITEMS, IN PARTICULAR DIRTY LAUNDRY ITEMS

(71) Applicant: Herbert Kannegiesser GmbH, Vlotho (DE)

(72) Inventors: Jürgen Sielermann, Heubach (DE); Wilhelm Bringewatt, Porta Westfalica (DE); Engelbert Heinz, Vlotho (DE)

(73) Assignee: Herbert Kannegieser GmbH, Vlotho (DE)

( * ) Notice: Subject to any disclaimer, the term of this patent is extended or adjusted under 35 U.S.C. 154(b) by 0 days.

(21) Appl. No.: 14/950,092

(22) Filed: Nov. 24, 2015

(65) Prior Publication Data

US 2016/0144407 A1 May 26, 2016

(30) Foreign Application Priority Data

Nov. 26, 2014 (DE) ..... 10 2014 017 478

(51) Int. Cl.

| | |
|---|---|
| ***B07C 5/00*** | (2006.01) |
| ***B07C 5/34*** | (2006.01) |
| ***D06F 93/00*** | (2006.01) |

(52) U.S. Cl.

CPC ..... *B07C 5/34* (2013.01); *D06F 93/00* (2013.01)

(58) Field of Classification Search

CPC ..... B07C 5/34; B07C 5/342; D06F 67/04
USPC ..... 209/937, 938, 597
See application file for complete search history.

(56) References Cited

U.S. PATENT DOCUMENTS

| | | | | |
|---|---|---|---|---|
| 3,819,046 A * | 6/1974 | Klema | B07C 5/344 209/559 |
| 4,036,365 A * | 7/1977 | Rosenfeld | B07C 5/3412 209/3.1 |
| 4,991,719 A * | 2/1991 | Butcher | B07C 5/3412 198/349.95 |
| 5,305,895 A * | 4/1994 | Hermann | G01B 11/02 209/586 |

(Continued)

FOREIGN PATENT DOCUMENTS

| | | | |
|---|---|---|---|
| DE | 4330911 A1 | 3/1995 | |
| EP | 2113606 A2 * | 11/2009 | D06F 93/00 |
| EP | 2789730 A1 * | 10/2014 | D06F 93/00 |

OTHER PUBLICATIONS

European Patent Office, Europaischer Recherchenbericht (search on related application), dated Jan. 12, 2016.

*Primary Examiner* — Terrell H Matthews
(74) *Attorney, Agent, or Firm* — Laurence P. Cotton; Smit Tempel Blaha LLC

(57) ABSTRACT

The sorting of laundry items, in particular dirty laundry items, has hitherto been carried out manually in most cases, which is costly in terms of personnel and time. High sorting capacities are therefore only possible with the corresponding personnel expenses. The invention provides that, at the start of sorting, specifically during their separation, and prior to their further transport to the individual sorting sites, the dirty laundry items are scanned by imaging techniques and, as a result of the appropriate image analysis, it is possible to determine the areas of the dirty laundry items to be preferably gripped and/or at least a number of sorting criteria, such as size and color. These measures result in a largely automated sorting procedure. These measures can be extended so as to achieve a fully automatic sorting procedure.

19 Claims, 1 Drawing Sheet

(56) References Cited

U.S. PATENT DOCUMENTS

| | | | | |
|---|---|---|---|---|
| 6,501,553 | B1 * | 12/2002 | Ogawa | G01B 11/026 356/497 |
| 6,734,978 | B2 * | 5/2004 | Adachi | G01B 11/2441 356/497 |
| 9,230,329 | B2 * | 1/2016 | Lukka | G06T 7/004 |
| 2015/0292142 | A1 * | 10/2015 | Tautz | B25J 11/00 414/800 |

* cited by examiner

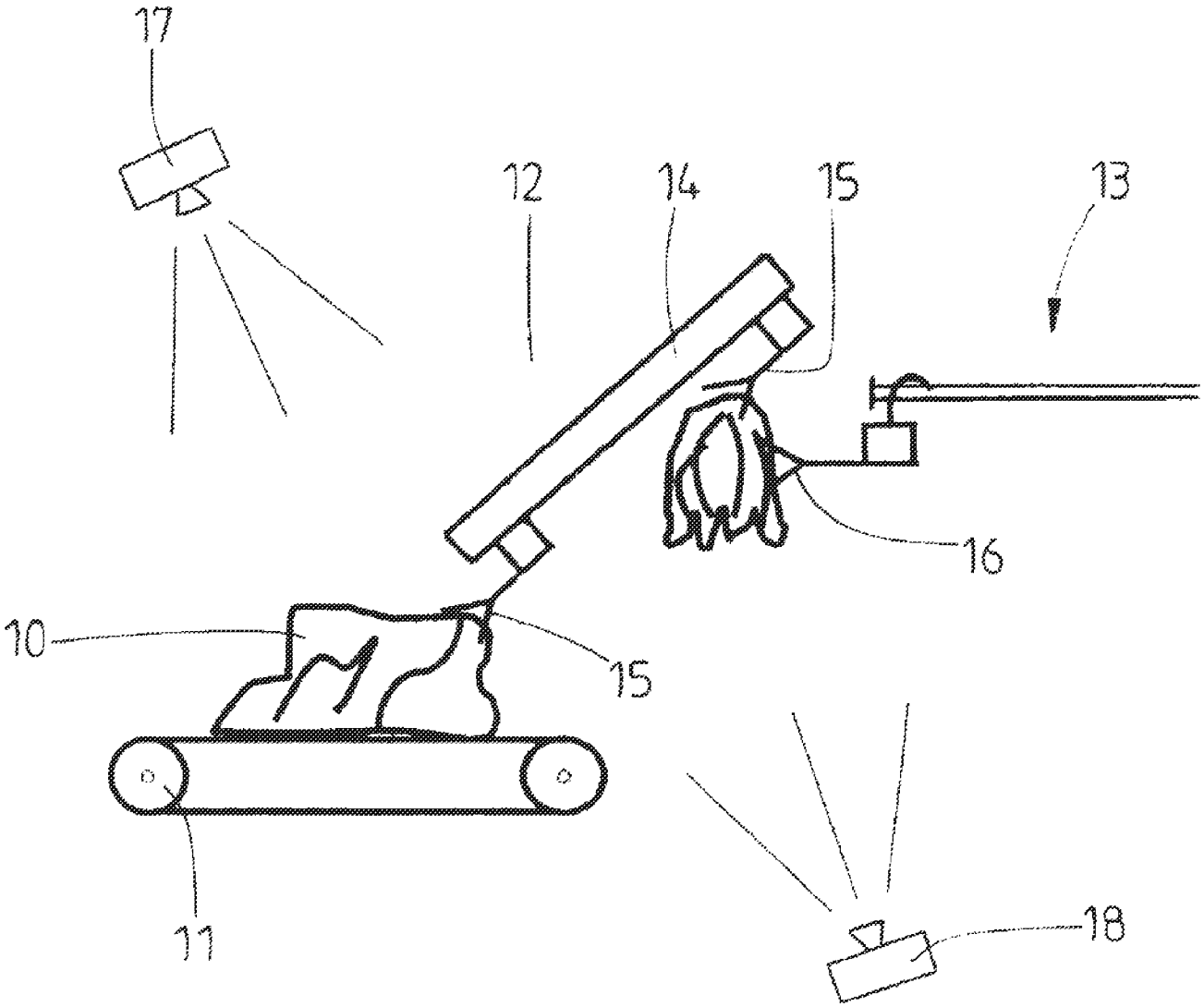
13
15
14
12
17
16
15
10
18
11

METHOD FOR SORTING LAUNDRY ITEMS, IN PARTICULAR DIRTY LAUNDRY ITEMS

CROSS REFERENCE TO RELATED APPLICATIONS

This patent application claims the benefit of and priority on German Patent Application No. 10 2014 017 478.6 having a filing date of 26 Nov. 2014.

BACKGROUND OF THE INVENTION

Technical Field

The invention relates to a method for sorting laundry items, in particular dirty laundry items, wherein laundry items are taken individually from a delivered batch of laundry and the respective laundry item transferred to a transport system which transports the laundry item to a sorting station where the laundry item is deposited by the transport system at a dropping point which, on the basis of related information, corresponds to at least one sorting criterion of the laundry item.

Prior Art

Laundry items, in particular dirty laundry items to be washed or laundry items to be finished, are sorted after delivery in a laundry so that they can be washed, finished or treated in some other way in a purposeful manner.

The laundry items, and above all the dirty laundry items, are usually delivered in batches, for example in laundry bags or laundry containers. The laundry items must therefore be separated before being sorted. In most cases, this is carried out manually.

The sorting operation which follows the separation of the laundry items is effected by way of information that can be gathered from the geometry, size, color and/or the type of fabric of the dirty laundry item. Other types of information are derived from the laundry items by an operator, for example by using a read device to transfer information from an information carrier located on the laundry item.

The sorting activities described above are expensive in terms of labor and time.

BRIEF SUMMARY OF THE INVENTION

The object of the present invention is to create a method for sorting laundry items, in particular dirty laundry items, which is automated at least for the most part, preferably completely automated.

A method for solving the aforementioned task comprises a method for sorting laundry items, in particular dirty laundry items, wherein laundry items are taken individually from a delivered batch of laundry and the respective laundry item transferred to a transport system which transports the laundry item to a sorting station where the laundry item is deposited by the transport system at a dropping point which, on the basis of related information, corresponds to at least one sorting criterion of the laundry item, characterized in that a surface profile of at least one laundry item of the delivered batch of laundry is determined, that at least on the basis of the surface profile a location is determined at which the laundry item can be gripped by a gripping means and that this location on the laundry item is gripped in a targeted manner by the gripping means.

This method is characterized in that a surface profile, in particular a topography, of the respective laundry item of the delivered batch of laundry is determined and, on the basis of this surface profile or topography, a location on the laundry item is identified at which it can and/or should be gripped by a gripping means of the transport system. The item of laundry is then gripped at this location by the gripping means in a targeted manner. This results in an automatic separation of the laundry item from the pile of laundry.

One advantageous option of the method provides that the gripping means having at least one high-speed servo axis is moved toward a significant location identified by the recorded surface profile or recorded topography of the laundry item. Such a high-speed servo axis can be formed by an electrically or pneumatically driven linear drive unit such as a pneumatic cylinder or a rack-and-pinion drive powered by an electric motor. Such linear drives are capable of achieving quite high acceleration and speed rates and consequently short transfer times. This results above all in short cycle times due to the identified position of the preferred location on the laundry item to grip as determined, in particular calculated, by imaging methods.

Preferably the method can be further refined by a position, calculated from the recorded surface profile or recorded topography of the laundry item, of a location that is intended or suited for the gripping of the laundry item. The gripping means can then be moved toward this location in a controlled, targeted manner, in particular on at least one high-speed servo axis for moving the gripping means. Here, too, it is possible to achieve short cycle times and a high sorting capacity.

According to another possible further development of the method, it is provided that the surface profile or the topography of the respective laundry item is recorded stereoscopically by at least one camera, preferably a number of cameras, at different positions. This makes it possible to record a three-dimensional image of the respective laundry item prior to and/or after the separating process. The use of electronic image processing makes it possible to identify automatically a location which is particularly easy to grip, preferably a location where the laundry item exhibits a significant curvature but also different characteristic features of the laundry item as a whole or at least a representative part of said laundry item.

Provision is preferably made that, on the basis of the recorded surface profile, in other words the topography from which the three-dimensional image of the laundry item can be determined, it is possible to calculate where a convenient or required location on the laundry item for gripping is situated and that the position of this location can be calculated in triaxial coordinates. After the targeted gripping or suction handling of the laundry item, it can then be pulled out of the pile of laundry and thereby deliberately separated out from the laundry.

The method can be designed such that, preferably after a laundry item has been separated out, the laundry item is graphically recorded by an imaging device, if possible including its topography or surface profile, and with the image of the laundry item recorded in this manner at least one sorting criterion of the laundry item is determined or derived. Accordingly, as least a number of sorting criteria for the laundry item can be reliably established automatically in a simple manner without the need of operating personnel.

The image of the laundry item recorded by the imaging device, particularly when it is a colored, three-dimensional image, can be preferably used to determine the shape, size, structure or type of fabric and/or the color of the laundry item and to derive therefrom at least one part of the sorting criteria of the laundry item.

Further, the method can be configured such that the laundry item is graphically recorded by the imaging device prior to its transfer or during its transfer on a fastening means of the transport system. This position is particularly suitable for making at least one image of the laundry item, from which at least one sorting criterion can be derived. As an alternative or in addition, the image recorded by the imaging device can be used to influence the transfer operation of the laundry item to the fastening means of the transport system, in particular to control or regulate it. This can thereby result in a more reliable automatic transfer of the laundry item from the separating station to the following transport system.

It is particularly advantageous to employ the image recorded by the imaging device for determining at least several sorting criteria of the laundry item and to control or regulate the transfer process of the laundry item to the transport system. This results in an appreciable increase in the sorting capacity because the preparations involved in sorting the laundry items, in particular the dirty laundry items, can be carried out not only fully automatically but also with short cycle times made possible by the automation.

BRIEF DESCRIPTION OF THE DRAWING

In the following, the invention will be described in more detail as based on the drawing. The single FIGURE of the drawing, FIG. 1, shows a schematic view of one part of a sorting device for in particular dirty laundry items, namely the preparation of dirty laundry for sorting purposes.

DETAILED DESCRIPTION OF PREFERRED EMBODIMENTS

In this description it is assumed that the laundry items to be sorted are dirty laundry items that have been delivered to a laundry. Referring to FIG. 1, the dirty laundry items 10 are first sorted before being washed, dried and, if appropriate, ironed and/or folded. The dirty laundry items 10 can be so-called shaped pieces, such as table linen, bed linen or the like, but can also be shaped pieces such as items of clothing, in particular workwear garments. The dirty laundry items 10 are usually delivered to the laundry unsorted in laundry bags or also in laundry containers.

In the shown exemplary embodiment, a pile containing a plurality of dirty laundry items 10 is fed by a conveyor, specifically a belt conveyor 11 in the FIGURE, from a laundry bag, for example, to a sorting station. In the FIGURE only a front part, i.e. the start, of the sorting station is shown. This is a separation device 12, which is followed by the start of a transport system 13, which transports separated dirty laundry items 10 to the appropriate dropping points of the sorting station, thereby sorting the items by dropping them at the dropping point corresponding to the sorting criterion of the respective dirty laundry item 10.

The pile containing a plurality of dirty laundry items 10, which are usually tossed together, and possibly also intertwined with each other, is transported by the belt conveyor 11 into the operating area of the separation device 12 and gripped by a clamp 14 of the separation device 12 and thereby separated. The shown separation device 12 has a linear and diagonally ascending elongated rail 14, on which, as shown in the exemplary embodiment, two clamps 15 for the purposes of separation can be moved. The two clamps 15 alternately grip a dirty laundry item 10 from the pile containing a plurality of dirty laundry items 10 which still lies on the belt conveyor 11. While one clamp 15 grips a dirty laundry item 10 at the lower end region of the rail 14, the other clamp 15 at the top end region transfers a separated dirty laundry item 10 to a clamp 16 of the transport system 13.

The separation device 12 is assigned an imaging device, which determines the surface profile or topography of the pile containing a plurality of dirty laundry items 10 located at the separation site. This imaging device is equipped with at least one camera 17 as suggested in the FIGURE. Preferably the imaging device has two or more cameras 17, which are arranged at different positions in order to record and generate by stereoscopic means a three-dimensional picture of the pile containing a plurality of laundry items 10. The image of the surface profile or topography of the pile of a plurality of laundry items 10, recorded by preferably a plurality of cameras 17, is then electronically evaluated by image processing in that a three-dimensional surface model of at least one significant part of the dirty laundry item 10 is determined. This is used to determine which dirty laundry item 10 can best be gripped and to detect which location on it is most suitable for being gripped by the clamp 15. Such a location is characterized by a small radius of curvature, a distinctive curvature or a large curvature gradient. Preferably the dirty laundry item 10 chosen for separation has a fold, a crease, an edge or a corner at the detected location.

At the location determined by image capture and image evaluation the clamp 15 of the separation device 12 grips the next dirty laundry item 10 to be drawn out of the pile containing a plurality of dirty laundry items 10. By being run up along the rail 14, the gripped dirty linen item 10 is pulled out of the pile and thereby separated from it.

The separated dirty laundry item 10 is run up the rail 14 by the clamp 15 until it reaches the upper end region of the rail 14. There the individual dirty laundry item 10, which has been gripped by the clamp 15 at an arbitrary location, hangs down from the clamp 15.

Another imaging device records the surface profile or the topography of the dirty laundry item 10 hanging down from the clamp 15 at the upper end region of the rail 14. The FIGURE shows schematically only one camera 18 of the imaging device for recording the dirty laundry item 10 hanging down from the clamp 15. Here a single camera 18 can be sufficient for recording a significant part of the surface profile of the dirty laundry item 10, preferably one side of the same. It is also conceivable that here too a three-dimensional surface model, in particular the topography, of the dirty laundry item 10 hanging down from the clamp 15 is determined stereoscopically by employing a plurality of preferably identical cameras 18. Preferably the cameras 18 or even only the one camera 18 constitute a camera 18 that can produce a color image of the dirty laundry item 10.

The at least one camera 18 determines not only the surface profile or topography of the dirty laundry item 10 under the clamp 15 but also at least one sorting criterion relevant to the sorting process. This may involve the profile or shape, the size, the color and/or the fabric surface structure of the dirty laundry item 10 hanging down from the clamp 15.

The surface profile or topography of the dirty laundry item 10 hanging down from the clamp 15 as recorded by at least one camera 18 can also be used to determine that location on the dirty laundry item 10 that is particularly suited for being gripped by the clamp 16 of the transport system 13. This can involve an arbitrary location on the dirty laundry item 10, but if necessary also a significant location such as an edge or corner of the dirty laundry item 10. The dirty laundry item 10 is gripped by the clamp 16 of the transport system 13 at this location and transported along the transport system 13 to the dropping point corresponding to the sorting criterion in order to complete the sorting process.

It is conceivable that the transport system 13 or the clamp 16 of same is assigned a weighing mechanism which determines the weight of the dirty laundry item 10 hanging on the clamp 16.

In the following, the method according to the invention will be described in more detail with reference being made to the FIGURE of the drawing:

The dirty laundry items 10 delivered to the laundry facilities are fed in batches or piles to the separation device 12 by the belt conveyor 11 to the start of the sorting station. In this process a pile of unsorted dirty laundry items 10, which are tossed together and possibly intertwined with each other, arrives at the separation device 12.

A three-dimensional image is recorded by preferably a plurality of cameras 17 of the surface structure or topography of the pile of dirty laundry items 10 on the belt conveyor 11, with this image being used to calculate data of a three-dimensional surface model of the dirty laundry item 10. A graphic image is recorded by at least two cameras 17 of the pile containing a plurality of dirty laundry items 10 from at least two different angles. A three-dimensional image of the pile of dirty laundry items 10 is thereby displayed, making it possible to determine three spatial coordinates. For this purpose, the three-dimensional coordinates X, Y and Z of each point or several points on the surface of the pile and/or of a single dirty laundry item 10 are calculated. The resulting three-dimensional image of the surface structure or topography of the pile of dirty laundry items 10 is electronically processed, preferably with a computer (not shown), data of the three-dimensional surface model are calculated and preferably also stored.

The cameras 17 can record images continuously in order to determine the surface profile or the topography of the dirty laundry items 10. But it is also conceivable that pictures are recorded at regular intervals. What is decisive is that, before a dirty laundry item 10 is gripped from the pile, the topography or surface profile of the next dirty laundry item 10 to be gripped and separated has been determined.

Once image processing has determined the topography or surface profile of the visible dirty laundry items 10 located in the pile, a dirty laundry item 10 that is particularly suited for being gripped is identified and a location on this dirty laundry item 10 is determined which is particularly suited for being gripped and separated. This is preferably such a location at which the individual dirty laundry item 10 can be reliably gripped and drawn out of the pile containing a plurality of dirty laundry items 10. A location on the dirty laundry item 10 that is particularly suitable for this purpose is one which has a small radius of curvature, in other words a distinctive curvature and/or a large curvature gradient, for example, a fold, a crease, an edge and/or a corner of the dirty laundry item 10. For the purpose of determining said location, the topography or the surface profile of the image of the pile of dirty laundry items 10 taken by the camera, in particular of the laundry item that is the preferred one for being gripped, is evaluated such that, for respectively adjacent points, the angle between two tangents or tangential planes of these points is determined. If this angle is flat, for example, the dirty laundry item 10 has a large radius of curvature at this location. If, on the other hand, the angle is acute or if the tangents do not intersect at all, one can assume a small radius of curvature, in other words, a location that is appropriate for separating the dirty laundry item 10.

Based on the location on the dirty laundry item 10 which is particularly suitable for being gripped, the electronically identified or calculated coordinates of the particularly suitable location for gripping are transmitted by the image analysis apparatus, in particular a computer, to a controller of the clamp 15. By means of this controller the clamp is moved with its high-speed servo axis 15 precisely toward the location on dirty laundry item 10 that has been identified and calculated by image processing or image analysis.

If the determined surface profile or topography of the dirty laundry item 10 results in more than one location being identified as suitable for gripping, an evaluation is conducted as to which location is best suited, in particular situated at the shortest distance from the clamp 15 or which can be approached by the latter most quickly.

If necessary, provision can be made for detecting a specially defined location, for example, an edge or a corner of the dirty laundry item 10. For the purpose of this detection, a library containing a large number of recorded significant locations, in particular corners and edges, that have been recorded by the cameras 17 of previous dirty laundry items 10, can be stored in the image processing device or evaluation device, for example a computer, and used to make a comparison.

After the clamp 15 of the separation device 12 has gripped the preferred location of the dirty laundry item 10 that was identified by the at least one camera 17 and calculated by image processing, the clamp 15 is run up along the rail 14 with a high-speed servo axis, thereby pulling the dirty laundry item 10 it is holding out of the pile of a plurality of dirty laundry items 10 and thereby separating it from the pile. After the clamp 15 with the separated dirty laundry item 10 has been run up along the rail 14 to the end position at the opposite end of the rail 14, the dirty laundry item 10 has been pulled out of the pile far enough that it hangs down freely from the clamp 15. Here is where a transfer of dirty laundry item 10 from the clamp 15 to the clamp 16 of the transport system 13 takes place. At this transfer point the dirty laundry item 10 is also recorded graphically by at least one camera 17 in order to create an image of it. At this transfer point, it may be sufficient to record merely a two-dimensional image of the dirty laundry item 10. But it is preferred that a three-dimensional image is stereoscopically recorded also at the point of transfer of the dirty laundry item 10 from the clamp 15 by means of clamp 16 of the transport system 13, specifically and preferably a color image, which allows conclusions to be made concerning the surface profile and topography of the dirty laundry item 10 hanging on the clamp 15. This therefore makes it possible to detect a location on the dirty laundry item 10 which is particularly suitable for the transfer of the dirty laundry item 10 to the transport system 13, in particular for being gripped by the clamp 16.

At least one sorting criterion is also determined by the at least one camera 18. One sorting criterion or also a plurality of sorting criteria can also be derived from a two-dimensional image of the dirty laundry item 10 at the transfer point to the clamp 16. The sorting criteria can include the shape of the dirty laundry item 10. For example, a determination can be made as to whether the dirty laundry item 10 is a shaped piece (such as a piece of clothing) or a piece of flat linen (for example, a bed sheet). Furthermore, as an alternative or in addition, the size of the dirty laundry item 10, the surface structure of the dirty laundry item 10, in particular of the fabric, can additionally be determined, from which, for example, the type of fabric of the dirty laundry item 10 can be known. If the at least one camera 18 is a color camera, the image it records can also provide further information about the color of the dirty laundry item 10, in particular it can be established whether it is a piece of colored fabric. Alternatively or in addition, it is conceivable that the at least one recorded image of the dirty laundry item 10 can be used to determine whether this item has defects, such as holes, stains or is heavily soiled. Such laundry items can then be sorted out.

After a two- or three-dimensional image of the dirty laundry item 10 has been graphically recorded by the at least one camera 18, the dirty laundry item 10 is gripped and removed by the clamp 16 of the transport system 13 at the location determined by corresponding image analysis. The image analysis determines this location in the same manner as described with respect to the camera 17 at the separation site. If necessary, the weight of the dirty laundry item 10 in the state in which it hangs on the clamp 16, but also on the clamp 15, can be determined. From this a further sorting criterion can be derived.

The determination of the topography or the surface profile of the dirty laundry item 10 using at least one camera 18 can, as an alternative, also be carried out after the dirty laundry item 10 has been gripped by the clamp 16 of the transport system 13 and hangs down from this clamp 16.

The respective dirty laundry item 10 hanging on the clamp 16 is transported by the transport system 13 past the individual dropping points, being released from the clamp 16, in other words dropped, at that dropping point which corresponds to the sorting criterion, or if appropriate, to a combination of a plurality of criteria, as previously determined by the imaging recording and evaluation processes. This leads to the sorted drop-off of the dirty laundry item 10 by the transport system 13, with the dirty laundry item 10 landing in a container or also on a conveyor provided for the dirty laundry item 10 which corresponds to the at least one sorting criterion.

As described above, the individual dirty laundry items 10 are progressively separated from the pile containing a plurality of dirty laundry items 10 and subsequently sorted. Due to the processing and evaluation of the images recorded by the cameras 17 and 18, preferably three-dimensional surface profiles or topographies, the separating process as well as at least one portion of the sorting process are automated, and can therefore be performed on a fully automatic basis.

LIST OF DESIGNATIONS

10 dirty laundry item
11 belt conveyor
12 separation device
13 transport system
14 rail
15 clamp
16 clamp
17 camera
18 camera

What is claimed is:

1. A method for sorting laundry items, namely dirty laundry items, comprising:

taking dirty laundry items individually from a delivered batch of laundry of all types;

transferring individual dirty laundry items to a transport system which transports the laundry item to a sorting station wherein the laundry item is deposited by the transport system at a dropping point which, on the basis of related information, corresponds to at least one sorting criterion of the laundry item;

determining a surface profile of at least one laundry item of the delivered batch of laundry;

at least on the basis of the determined surface profile, determining a location on the laundry item at which the laundry item can be gripped by a gripping means;

gripping this determined location on the laundry item in a targeted manner by the gripping means; and pulling the laundry item, which is gripped by the gripping means at the determined location on the basis of the determined surface profile, out of the batch of laundry and separating the laundry item out from the batch of laundry in the process, into like types for washing.

2. The method as claimed in claim 1, wherein the gripping means has at least one high-speed servo axis and further comprising moving the gripping means toward the determined location on the laundry item that has been determined on the basis of the determined surface profile of the laundry item.

3. The method as claimed in claim 1, further comprising calculating the position of the determined location of the laundry item to be gripped on the basis of the determined surface profile of the laundry item, and moving the gripping means toward the calculated position in a controlled and targeted manner.

4. The method as claimed in claim 1, further comprising recording the surface profile of the respective laundry item stereoscopically by at least one camera.

5. The method as claimed in claim 1, further comprising graphically recording the laundry item by an imaging device and using the resulting image of the laundry item to derive at least one sorting criterion of the laundry item.

6. The method as claimed in claim 1, further comprising graphically recording the laundry item, following its separation, by an imaging device and using the resulting image of the laundry item to derive at least one sorting criterion of the laundry item.

7. The method as claimed in claim 1, further comprising graphically recording the laundry item by an imaging device, and then transferring the laundry item to a fastening means of the transport system.

8. The method as claimed in claim 1, further comprising transferring the laundry item to a fastening means of the transport system, and graphically recording the laundry item by an imaging device during the transfer of the laundry item to the fastening means of the transport system.

9. The method as claimed in claim 7, further comprising controlling the transfer process of the laundry item to the fastening means of the transport system on the basis of an image of the laundry item recorded by the imaging device.

10. The method as claimed in claim 8, further comprising controlling the transfer process of the laundry item to the fastening means of the transport system on the basis of an image of the laundry item recorded by the imaging device.

11. The method as claimed in claim 2, further comprising calculating the position of the determined location of the laundry item to be gripped on the basis of the determined surface profile of the laundry item, and moving the gripping means toward the calculated position in a controlled and targeted manner.

12. A method for sorting laundry items, namely dirty laundry items, comprising:

taking dirty laundry items individually from a delivered batch of laundry of all types;

transferring individual dirty laundry items to a transport system which transports the laundry item to a sorting station wherein the laundry item is deposited by the transport system at a dropping point which, on the basis of related information, corresponds to at least one sorting criterion of the laundry item;

determining a surface profile of at least one laundry item of the delivered batch of laundry;

at least on the basis of the determined surface profile, determining a location on the laundry item at which the laundry item can be gripped by a gripping means;

gripping this determined location on the laundry item in a targeted manner by the gripping means;

pulling the laundry item, which is gripped by the gripping means at the determined location on the basis of the determined surface profile, out of the batch of laundry and separating the laundry item out from the batch of laundry in the process, into like types for washing; and graphically recording the laundry item, following its separation, by an imaging device and using the resulting image of the laundry item to derive at least one sorting criterion of the laundry item.

13. The method as claimed in claim 12, wherein the gripping means has at least one high-speed servo axis and further comprising moving the gripping means toward the determined location on the laundry item that has been determined on the basis of the determined surface profile of the laundry item.

14. The method as claimed in claim 12, further comprising calculating the position of the determined location of the laundry item to be gripped on the basis of the determined surface profile of the laundry item, and moving the gripping means toward the calculated position in a controlled and targeted manner.

15. The method as claimed in claim 12, further comprising recording the surface profile of the respective laundry item stereoscopically by at least one camera.

16. The method as claimed in claim 12, further comprising graphically recording the laundry item by an imaging device and using the resulting image of the laundry item to derive at least one sorting criterion of the laundry item.

17. The method as claimed in claim 12, further comprising graphically recording the laundry item by an imaging device, and then transferring the laundry item to a fastening means of the transport system.

18. The method as claimed in claim 17, further comprising controlling the transfer process of the laundry item to the fastening means of the transport system on the basis of an image of the laundry item recorded by the imaging device.

19. The method as claimed in claim 2, further comprising calculating the position of the determined location of the laundry item to be gripped on the basis of the determined surface profile of the laundry item, and moving the gripping means toward the calculated position in a controlled and targeted manner.

* * * * *